US006050642A

United States Patent [19]

Erb

[11] Patent Number: 6,050,642

[45] Date of Patent: Apr. 18, 2000

[54] MULTI-DIRECTION RECLINING AND STRETCHING CHAIR

[76] Inventor: Scott C. Erb, 1012 Pendleton St, Alexandria, Va. 22314

[21] Appl. No.: 09/148,085

[22] Filed: Sep. 3, 1998

Related U.S. Application Data

[63] Continuation-in-part of application No. 08/831,344, Apr. 1, 1997, abandoned

[60] Provisional application No. 60/017,282, May 13, 1996.

[51] Int. Cl.[7] ..... A47C 1/032

[52] U.S. Cl. ..... 297/322; 297/259.2; 297/320; 297/325

[58] Field of Search ..... 297/317, 318, 297/320, 321, 322, 325, 326, 329, 258.1, 259.2

[56] References Cited

U.S. PATENT DOCUMENTS

| | | | |
|---|---|---|---|
| D. 224,422 | 7/1972 | Beach | D34/5 |
| 2,925,122 | 2/1960 | Wiuick | 297/318 |
| 2,928,457 | 3/1960 | Welsh | 297/322 |
| 3,066,981 | 12/1962 | Welsh | 297/317 |
| 3,124,388 | 3/1964 | Berlin | 297/320 |
| 3,252,734 | 5/1966 | Berlin | 297/322 X |
| 3,305,877 | 2/1967 | Nielsen | 5/67 |
| 3,315,666 | 4/1967 | Sellner | 128/25 |
| 3,359,035 | 12/1967 | Schiffer | 297/317 |
| 3,561,772 | 2/1971 | Curtess | 128/25 |
| 3,641,995 | 2/1972 | Brandt | 272/58 |
| 3,761,081 | 9/1973 | Simmons | 128/25 |
| 3,767,190 | 10/1973 | Biggerstaff | 272/58 |
| 3,934,932 | 1/1976 | Ekornes | 272/58 |
| 4,660,884 | 4/1987 | Terui et al. | 297/317 |
| 4,790,599 | 12/1988 | Goldman | 297/320 |
| 5,098,158 | 3/1992 | Palarski | 297/327 |
| 5,531,658 | 7/1996 | L.S.C. | 297/330 |

FOREIGN PATENT DOCUMENTS

| | | | |
|---|---|---|---|
| 980675 | 12/1975 | Canada | 297/342 |
| 2583-370 | 12/1986 | France | 297/90 |
| 474027 | 10/1937 | Germany | 297/68 |
| D 17358 | 11/1955 | Germany | 297/96 |
| 2153417 | 4/1980 | Germany | 297/90 |
| 3110111 | 9/1982 | Germany | 297/96 |

OTHER PUBLICATIONS

"Kinematics and Linkage Design" by Allen S. Hall, Jr. 1961.

Brochure: "Backsaver"; Backsaver Products Co.—Not Dated.

Brochure: "Untitled", Atelier Intl. Ltd.—Not Dated.

*Primary Examiner*—Peter R. Brown

*Attorney, Agent, or Firm*—Pravel Intellectual Property Law, P.C.

[57] ABSTRACT

A multiple position, reclining and stretching chair includes a base structure having side walls with corral openings into which the ends of an axle extend. The axle is rotatably secured to a lumbar platform that is a part of a multi-panel body support platform assembly. The body support platform assembly is positioned above an arcuate, adjustable, lockable, contact support structure that pivots forward and rearward about one or more pivot members either or both of which that may be substantially attached to the base structure. The contact support structure may also comprise two sets of independently acting contact support members that allow the front roller to move independently of the rear roller. Also disclosed is an embodiment wherein the arcuate roller assembly rocks back and forth about the surface of a horizontal cross support member of the base structure.

44 Claims, 6 Drawing Sheets

MULTI-DIRECTION RECLINING AND STRETCHING CHAIR

CROSS REFERENCE TO RELATED APPLICATIONS

This application is a continuation-in-part of application Ser. No. 08/831,344, filed Apr. 1, 1997; now abandoned, that claims the benefit of U.S. Provisional Application No. 60/017,282 filed May 13, 1996.

FIELD OF THE INVENTION

This invention relates generally to the field of multi-direction reclining and stretching chairs.

BACKGROUND OF THE INVENTION

Reclining and stretching chairs are not new per se. Chairs that recline have been manufactured for many years. With the development of anatomical and ergonomic engineering, reclining chairs have evolved to be more comfortable and more versatile.

Various chairs have been designed that provide the capability to stretch and strengthen muscles. For example, U.S. Pat. No. 3,561,772 discloses a lightweight, reclining and exercising device that includes pivoting panels that are connected with a fixed pivot member. The chair is specifically designed to stretch and strengthen the back muscles. U.S. Pat. No. 3,641,995 shows an exercising chair that also includes a fixed pivot axle between a seat and a back section and is used to exercise the back and leg muscles.

There are also numerous chairs manufactured that are primarily designed to recline and be comfortable. Many of the existing recliners include interconnected platform members that are adjustable in different ways. In U.S. Pat. No. 3,934,932 the angle between an interconnected seat and back platform is adjusted with a frictional coupler that is attached to the seat platform and a tubular portion of the base. U.S. Pat. No. 4,790,599 shows a chair having a fixed angle between the chair and the seat platform. The combined chair and seat platform swings about a raised pivot point and is adjusted along a fixed track positioned on the base of the chair.

What is needed is a chair that can be moved by the user through a range of different therapeutic and generally comfortable motions including tilting, rocking and angular changing between platform components on the body platform assembly. The chair should allow the person sitting, reclining or stretching in the chair to be able to change the angular position of the platform components freely by shifting their weight. Ideally, the chair should be easy to lock in any desired position.

SUMMARY OF THE INVENTION

The present invention provides a new and improved chair design that allows interconnected seat and back platform members to move freely relative to the confines of corrals. Each end of an axle member that is rotatably attached to the center portion of the body support platform extends beyond each side of the body support platform and into the corrals in the side walls of the base. The corrals are defined by openings or indentations in the side walls of the base of the chair. The corral openings can be in the shape of a oval, a circle or in the shape of a slot. The corral openings can also be of an amorphous shape having semi-circular regions about the perimeter configured generally to cooperate with the axle. Typically, the corral openings are at least one and one half times the diameter of the axle members in all directions. The chair includes a roller assembly that is positioned between the base and the interconnected body support platform. In the first preferred embodiment, the roller assembly includes contact support members that can pivot and lock relative to the base. One roller is attached to one end of the contact support members and a second roller is attached to the other end of the contact support members. An optional leg platform can be interconnected to the seat platform and an optional head platform can be attached to the back platform. An additional pivoting section can be formed as a part of the back section to create a section localized to the lumbar portion of the back.

The individual platforms can be interconnected with adjustable hinges. The adjustable hinges may be fixed in position or provided with a spring assisted tensioning mechanism.

In a second preferred embodiment the arcuate contact support structure rolls back and forth on the upper surface of a horizontal base member.

In a third preferred embodiment a guide structure is positioned parallel to one or both sides of the contact support structure between the contact support structure and one or both walls of the base structure. Control rods or control segments extend outward from the contact support structure into guide slots positioned on the guide structure. The guide structure provides structural stability to the base structure and to the entire chair assembly.

In a fourth preferred embodiment the base structure includes two spaced apart pivot members that cooperate with two spaced apart notches that are positioned on the lower side of the contact support structure. This embodiment may also include a guide structure to increase the structural stability of the chair assembly.

In a fifth preferred embodiment the contact support structure includes separate front and rear members. Each of the separate members includes a roller member on the top and each member is independently adjustable along a guide slot.

The resulting construction in any of the preferred embodiments provides a wide range of comfortable seating, reclining and stretching positions. Because the body platform is free to move on the axle within the annular corral, the chair provides the user with the capability to stretch their back whether they are sitting, reclining or fully stretching out in a prone position. The chair in the first preferred embodiment can be positioned in a conventional upright orientation. The chair can be entered in the conventional manner and reclined if the person in the chair leans back by pushing back on the armrests and tilting the contact support structure on its pivot. The contact support structure can be fixed at any desired position by securing the control rod within the guide slots that are located on each side of the base structure. As the user leans further back in the chair and approaches a horizontal reclined position, the user's weight becomes nearly equally distributed and balanced between the two rollers, and simultaneously centered over the corral. With or without the roller assembly in a secured position, the user can then arch his or her back which lifts the axle within the corrals. In any position, the user can relax and the chair will stay in position even with the axle "free floating" within the corrals. This unexpected and surprising advantage is caused by the frictional interface between the roller members and the body support platform assembly. The body support platform assembly includes a back, seat, lumbar and optional head and leg platforms. Each of the body platform sections can be interconnected with resilient, locking, spring connections.

The body support platform assembly allows the user to flex his or her body into any position while simultaneously providing support for all parts of the body in all positions. The body support platform can be urged into the desired position and it will stay in place until the user moves. The user is free to move, stretch or resituate into any desired position on the chair.

The chair provides several additional surprising and unexpected advantages. For example, when the user is near the reclined (or horizontal) position, the user can lie on his or her side or stomach and the chair will move as required to accommodate the user's movements. The user can also rock back and forth on the contact support pivot and flex up and down within the corral. The two combined motions can create a therapeutic circular rolling effect. The user can also pull down on the arms of the chair to cause the chair to float down into the conventional upright position and then easily get out of the chair.

BRIEF DESCRIPTION OF THE DRAWINGS

For a further understanding of the nature and objects of the present invention, reference should be made to the following detailed description taken in conjunction with the accompanying drawings, in which like parts are given like reference numerals and wherein.

DETAILED DESCRIPTION OF PREFERRED EMBODIMENT

Figure 1:
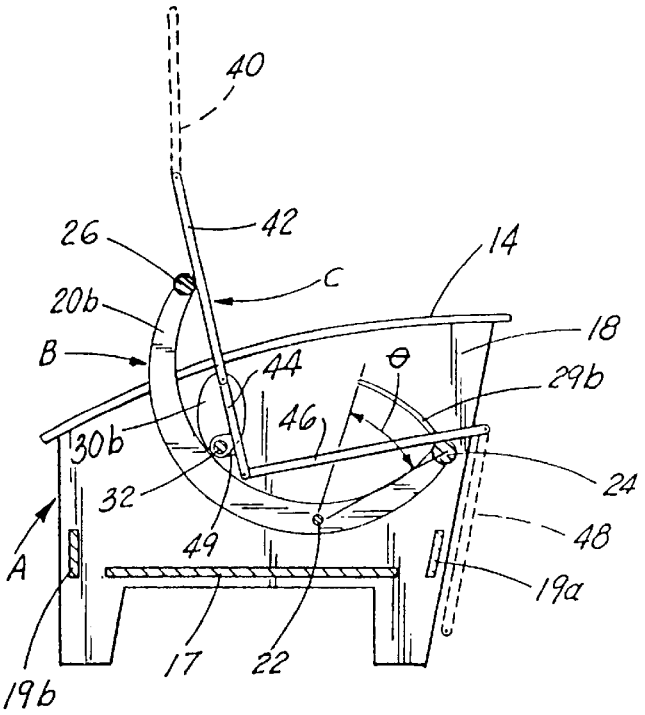
FIG. 1 is a longitudinal sectional view of the chair shown in a seated position with optional head and leg platforms.

The following table lists the part numbers and part descriptions as used herein and in the drawings attached hereto:

| Part Number: | Description: |
|---|---|
| A | Base Structure |
| B | Contact Support Structure |
| C | Body Support Platform Assembly |
| 12 | Arm Rest - first side |
| 14 | Arm Rest - second side |
| 16 | Vertical Wall - first side |
| 17 | Horizontal Cross Support Member |
| 18 | Vertical Wall - second side |
| 19a,19b | First and Second Vertical Cross Support Members |
| 20a,20b | Contact Support Members - first and second side |
| 22 | Contact Support Pivot, single |
| 22a,22b | Contact Support Pivot, front and rear |
| 23a,23b | Pivot Notch, front and rear |
| 24 | Front Roller |
| 26 | Rear Roller |
| 27 | Control Handle for Contact Support Pivot |
| 27a, 27c | Control Handle for Control Rod, front and rear |
| 27x, 27y | Control Handle for Contact Support Pivot, front and rear |
| 28 | Control Rod |
| 28a, 28b | Control Rod Segment, first and second side - front |
| 28c, 28d | Control Rod Segment, first and second side - rear |
| 29a, 29b | Guide Slots - first and second side - front |
| 29c, 29d | Guide Slots - first and second side - rear |
| 30a, 30b | Corrals - first and second side |
| 305a,305b, 305c, 305d, 305e | Configuration variations of corral |
| 31 | Resilient Material |
| 32 | Axle |
| 33 | Shortened Axle |
| 35a, 35b | Contact Support Members - first and second side - front |
| 35c, 35d | Contact Support Members - first and second side - rear |
| 36a, 36b | Guide Slot Pivots - first and second side - front |
| 36c, 36d | Guide Slot Pivots - first and second side - rear |
| 40 | Head Platform |
| 42 | Back: Platform |
| 44 | Lumbar Platform |
| 46 | Seat Platform |
| 48 | Leg Platform |
| 49 | Connector Bracket |
| 52a, 52b | First and Second Guide Structures |
| 54 | Adjustable Tensioning Hinge |
| D,E,F | Several Possible Positions of Contact Support Structure |
| G,H,I | Several Possible Positions of Body Support Platform Assembly |
| Θ | Angular Position of Control Rod |
| 51a,51b | First and Second Lower Support Slots |

Figure 2:
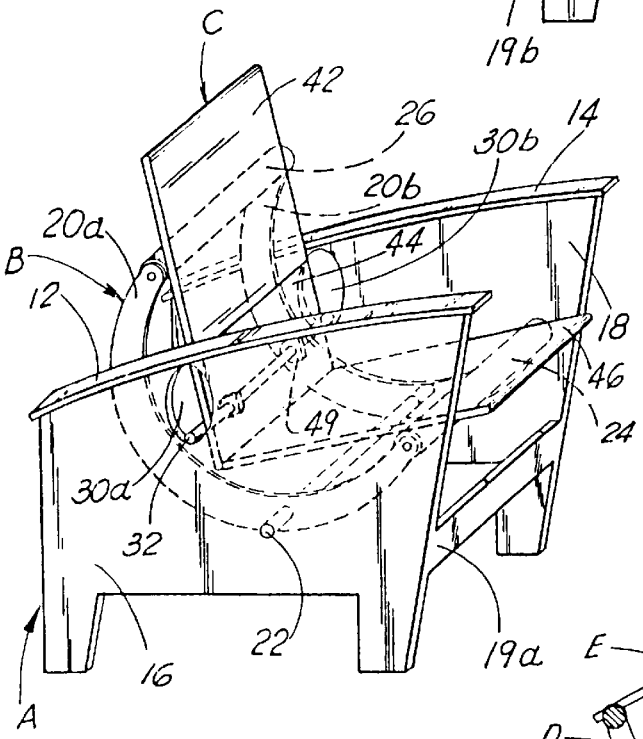
FIG. 2 is an axonometric view of the chair in a seated position.

Overall Construction:

Refer now to FIGS. 1 and 2, which show the first preferred embodiment of the multiple direction, reclining and stretching chair including the base structure A, the contact support structure B and the body support platform assembly C. The base structure A includes a first vertical wall 16 that is attached to a second vertical wall 18 with a first vertical cross support member 19*a*, a second vertical cross support member 19*b* and a horizontal cross support member 17. A first arm rest 12 is attached to the top of the first vertical wall 16 and a second arm rest 14 is attached to the top of the second vertical wall 18. Each of the vertical walls 16, 18 includes a corral defined by the oval shaped holes 30*a*, 30*b*. Typically, the corrals 30*a* and 30*b* are the same size and shape. However, the corrals 30*a*, 30*b* need not be the same shape and a corral is not necessary on each of the vertical walls 16,18. Instead, the axle 32 can extend into a single corral 30*a* or 30*b*.

Figure 12A:
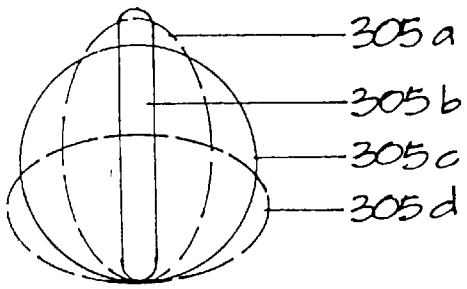
FIGS. 12*a* and 12*b* illustrate several possible shapes of the inventive corral.
Figure 12B:
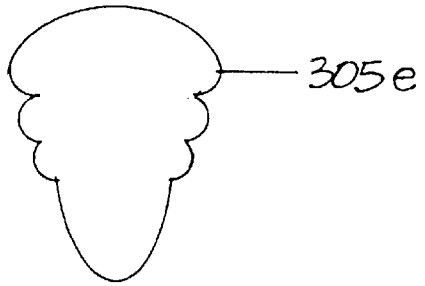

The corral can be shaped in a number of possible configurations. FIGS. 12*a* and 12*b* illustrate several possible variations. FIG. 12*a* shows several possible shapes of the corral. The corral is shown as a vertical oval 305*a* and as a horizontal oval 305*d*. The corral may also be in the shape of a vertical slot 305*b* or in the shape of a circle 305*c*. FIG. 12*b* illustrates yet another possible variation in the corral shape. The corral in FIG. 12*b* is an amorphous shape 305*e* having an irregular shaped perimeter for limiting the motion of the axle 32. In particular, FIG. 12*b* shows semi-circular regions about the perimeter that correspond generally to the exterior shape of the axle 32. It is contemplated that the variation in shape of the corral from the illustrative shapes will not depart from the spirit and scope of the invention.

Figure 3:
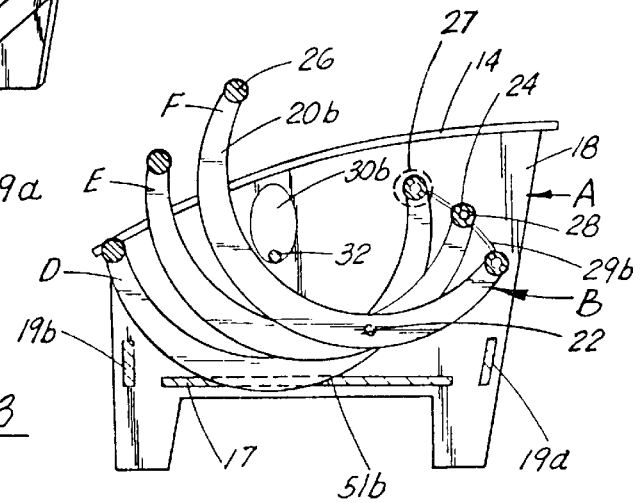
FIG. 3 is a longitudinal sectional view of the chair showing movement of the pivoted contact support.

The contact support structure B includes a first arcuate shaped contact support member 20*a* and a second arcuate shaped contact support member 20*b*. A front roller 24 is positioned at the front between the two roller support members 20*a*, 20*b* and a rear roller 26 is positioned at the rear between the two contact support members 20*a*, 20*b*. It is contemplated that the contact support structure B could engage the body support platform assembly C with a set of linear contacts rather than with rollers. A cylindrically shaped contact support pivot 22 extends through each of the two contact support members 20*a*, 20*b* and through each vertical wall 16, 18 of the base structure A. Refer to FIG. 3 which shows the control rod 28 positioned in the center of the front roller 24. The control rod 28 follows the guide slots 29*a*, 29*b*. The guide slots 29*a*, 29*b* can include cutouts that allow the control rod to be locked into position in any of a multiple number of locations along the guide slots 29*a*, 29*b*. A control handle 27 can be attached to the end of the control rod 28 to secure and lock the contact support structure into any of the possible positions along the length of the guide slots 29*a*, 29*b*.

Figure 4:
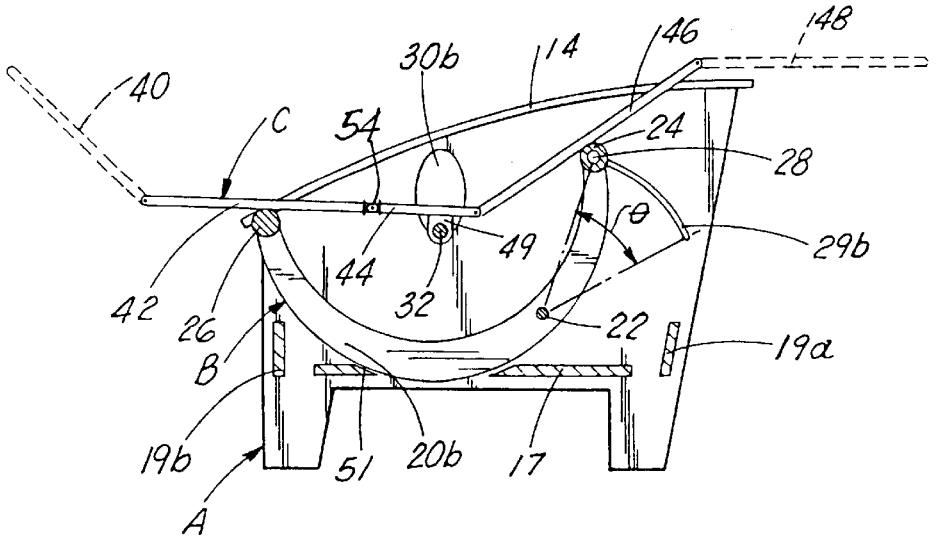
FIG. 4 is a longitudinal sectional view of the chair in the fully reclined position and showing the optional head and leg platforms.

The body support assembly C includes a back platform 42 that is pivotally connected to a lumbar platform 44. The lumbar platform 44 is pivotally connected to the seat platform 46. As illustrated in FIG. 4, the body support assembly C may optionally include a head platform 40, pivotally connected to the back platform 42. In addition, an optional leg platform 48 may be pivotally connected to the seat platform 46. The pivotal connections used on the body support platform members may also include spring biased members at the pivotal connections. The pivotal connections may also include adjustable tensioning means for adjusting variable tension between the individual platform elements (For example, see FIG. 4). The variable tension can be fixed to lock the relative position between individual platform elements.

An axle 32 is shown rotatably attached to the lumbar platform 44 with two connector brackets 49. Each end of the axle 32 extends beyond each outer edge of the lumbar platform 44 and into each corral 30*a* and 30*b*.

Figure 8:
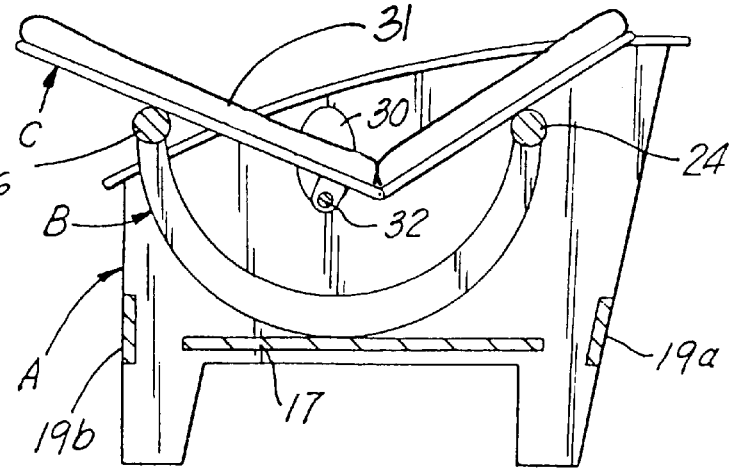
FIG. 8 is a longitudinal section view of the chair showing the contact support structure in rolling contact with the horizontal cross support member.

FIG. 8 illustrates a second preferred embodiment wherein the contact support structure B rolls on the top of the horizontal cross support member 17.

Figure 9:
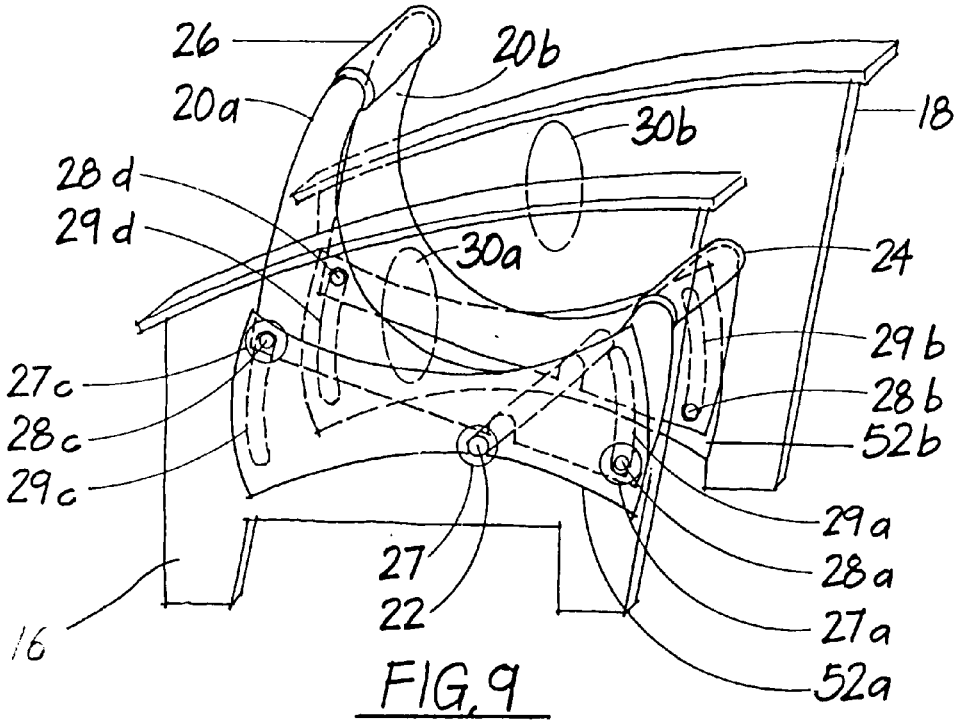
FIG. 9 is an axonometric view of the chair showing an embodiment having a single pivot member and a guide structure integral with each side of the contact support structure.

FIG. 9 illustrates a third preferred embodiment wherein the contact support structure includes control rod segments 28*a*,28*b*,28*c*,28*d* that cooperate with guide slots 29*a*,29*b*, 29*c*,29*d*. The guide slots 29*a*,29*b*,29*c*,29*d* limit the overall rotational motion of the contact support structure B as it rotates about the contact support pivot 22. The guide slots 29*a*,29*b*,29*c*,29*d* are cut through the guide structures 52*a*, 52*b*. The control rod segments 28*a*,28*b*,28*c*,28*d* could also span the width between each contact support member 20*a*, 20*b*. Control handles 27*a*,27*b*,27*c*,27*d* are releaseably attached to the control rod segments 28*a*,28*b*,28*c*,28*d* and allow the user to apply compression between the vertical walls 16,18, the contact support members 20*a*,20*b* and the guide structures 52*a*,52*b*. The applied compression fixes the position of the contact support structure B into the desired rotational position. Partial compression can also be applied with the control handles 27*a*,27*b*,27*c*,27*d* thereby reducing the speed of rotation of the contact support structure B. A control handle 27 may also be used to secure the position of the contact support structure B relative to the base structure A. The guide structures 52*a*,52*b* are optional and instead, the guide slots 29*a*,29*b*,29*c*,29*d* could be cut into the vertical walls 16,18. However, the guide structures 52*a*,52*b* provide additional structural stability to the vertical walls 16,18 and to the entire inventive chair.

Figure 10A:
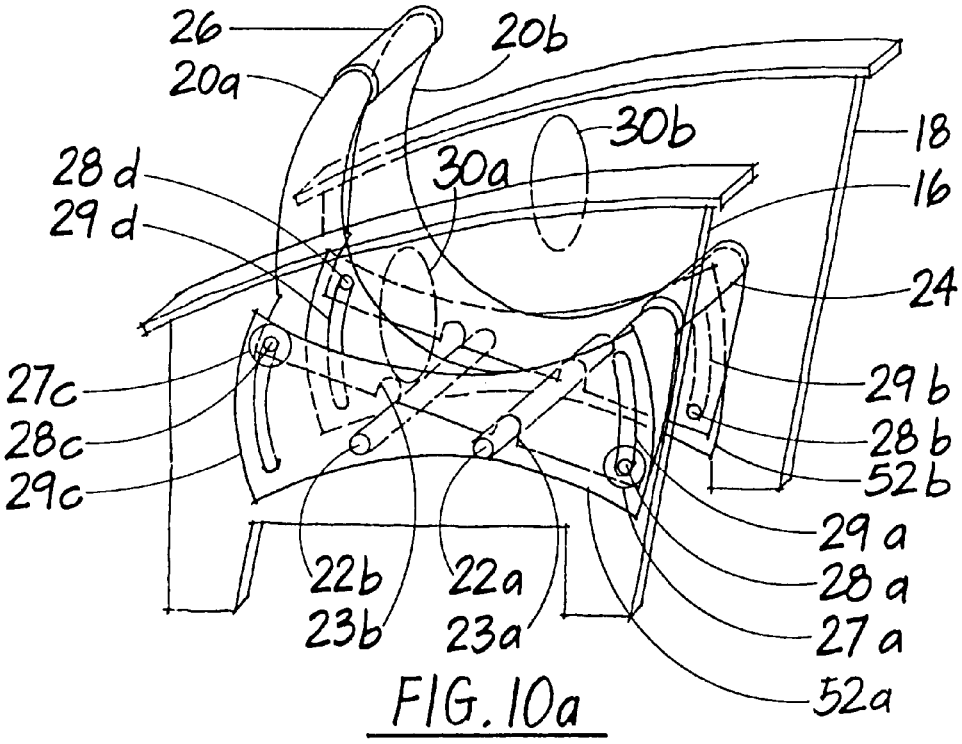
FIG. 10*a* is an axonometric view of the chair showing an embodiment having two pivot members and a guide structure integral with each side of the contact support structure.
Figure 10B:
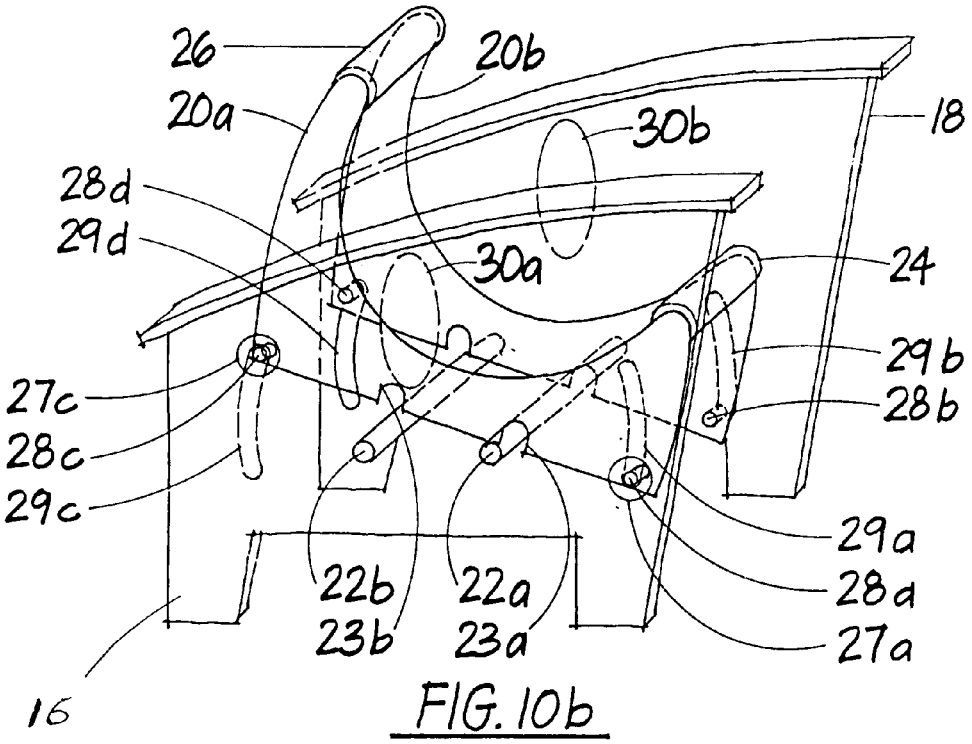
FIG. 10*b* is an axonometric view of the chair showing an embodiment having two pivot members and guide slots integral with each of the vertical side members.

FIGS. 10*a* and 10*b* illustrate a fourth preferred embodiment of the invention. The contact support members 20*a*, 20*b* include pivot notches on the lower side. In FIGS. 10*a* and 10*b*, the contact support member 20*a* shows pivot notches 23*a*,23*b* that cooperate with the front and rear contact support pivots 22*a*,22*b*. Similar contact support notches can also be provided on contact support member 20*b*. The multiple contact support pivots 22*a*,22*b* allow the contact support structure B to pivot about each of the individual contact support pivots 22*a*,22*b*. The overall rotation movement can be limited by the travel of the control rod segments 28*a*,28*b*,28*c*,28*d* which travel within the respective guide slots 28*a*,28*b*,28*c*,28*d*.

FIG. 10*a* includes the first and second guide structures 52*a*,52*b* that are substantially attached to the vertical walls 16,18. FIG. 10*b* does not include the guides structures 52*a*,52*b* and instead, includes guide slots 29*a*,29*b*,29*c*,29*d* cut directly into the vertical walls 16,18. The guide slots 29*a*,29*b*,29*c*,29*d* may either pass completely or partially through the guide structures 52*a*,52*b* or vertical walls 16,18.

Figure 10C:
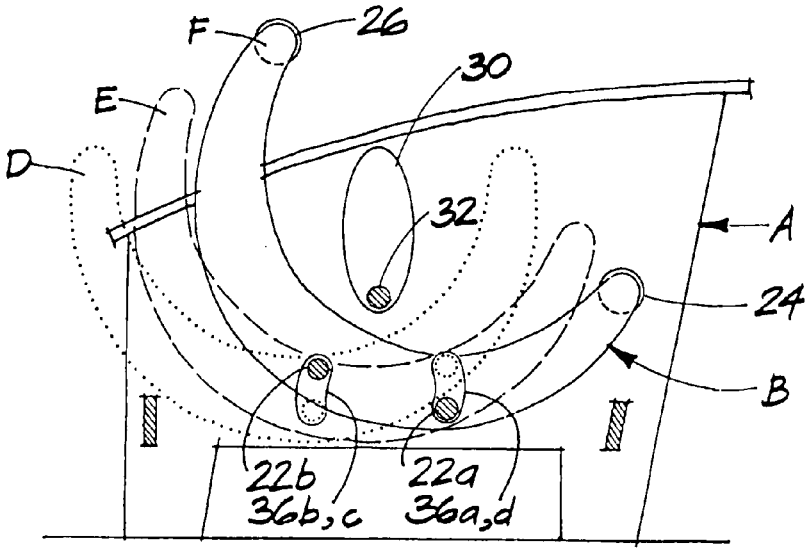
FIG. 10*c* is a longitudinal section view of the chair showing an embodiment having two pivot members attached to the guide structure and guide slots integral with each of the vertical side members.

FIG. 10*c* illustrates a variation of the fourth preferred embodiment of the invention. The contact support pivots 22*a*,22*b* are attached to the contact support structure B. One of the ends of each of the contact support pivots 22*a*,22*b* extends into the corresponding guide slot pivots 36*a*,36*b*. The other ends of the contact support pivots 22*a*,22*b* extends into the other corresponding guide slot pivots 36*c*,36*d*. The guide slot pivots 36*a*,36*b* limit the overall motion of the contact support pivots 22*a*,22*b*. The contact structure is shown in the rear position D, the intermediate position E and the forward position F. It is contemplated that guide slot pivots may be used on one or both sides of the chair. Although the guide slot pivots 36*a*,36*b*,36*c*,36*d* are shown as vertical slots, alternative configurations are also possible. For example, the guide slot pivots 36*a*,36*b*,36*c*,36*d* may be curvilinear or oval in shape.

Figure 11:
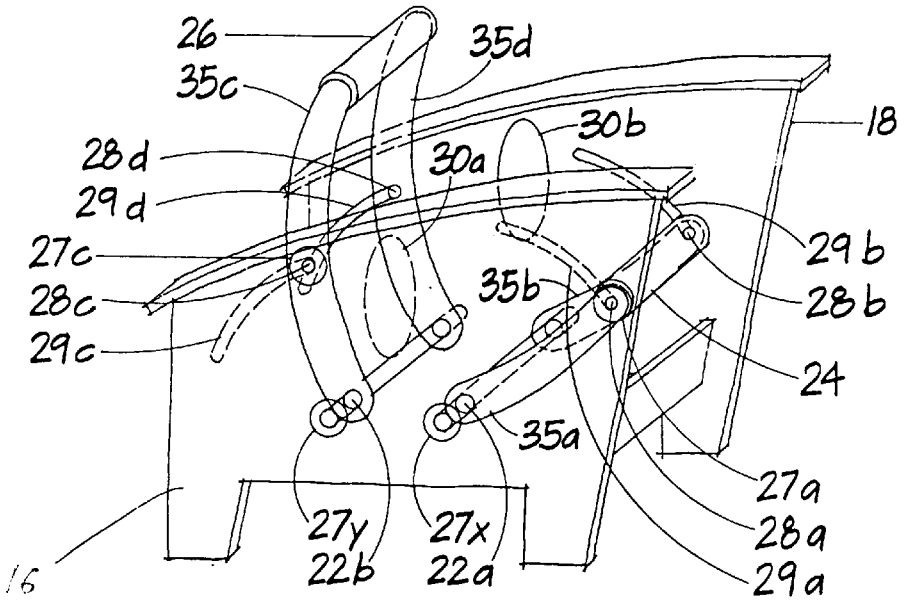
FIG. 11 is an axonometric view of the chair showing an embodiment having two sets of independently acting contact support members.

FIG. 11 illustrates a fifth preferred embodiment of the invention. The contact support structure B comprises two pairs of contact support members 35*a*,35*b*,35*c*,35*d*. The front pair of contact support members 35*a*,35*b* move independently from the rear pair of contact support members 35*c*,35*d*. The front contact support members 35*a*,35*b* include a front roller 24 that is mounted on a control rod 28. The control rod 28 travels within guide slots 29*a*,29*b* that are positioned on the vertical walls 16,18. Guide structures 52*a*,52*b* could also be used. An adjustment handle 27*a* is removeably attached to the end of the control rod 28 to provide compression between the vertical wall 16 and the front contact support members 35*a*,35*b*. A similar control handle could be connected to the opposite end of the control rod 28 outside of the opposite vertical wall 18. The rear contact support members 35*c*,35*d* include a rear roller 26. As with all of the inventive embodiments, the body support platform assembly C rests on the front and rear rollers 24,26. The rear contact support members 35*c*,35*d* include control rod segments 28*c*,28*d* that travel within guide slots 29*c*,29*d*. The guide slots 29*c*,29*d* are positioned on vertical walls 16,18. An adjustment handle 27*c* is removeably attached to the end of the control rod segment 28*c* to provide compression between the vertical wall 16 and the rear contact support members 35*c*,35*d*. A similar control handle could be attached to the control rod segment 28*d* outside of the opposite vertical wall 18.

Control handles 27*x*,27*y* may also be attached to provide adjustable compression on the front and rear contact support pivots 22*a*,22*b*.

It is also contemplated that the front contact support members include control rod segments that follow the guide slots 29*a*,29*b* instead of following the guide slots 29*a*,29*b* with the control rod 28 on which the front roller is mounted. If this alternative is used, the front roller would be mounted on a separate longitudinal axle member.

Operation:

Referring to FIGS. 1 and 2, the reclining and stretching chair includes a base structure A, a contact support structure B and a body support platform assembly C. The first and second vertical walls 16, 18 are structurally supported by first and second vertical cross support member 19*a*, 19*b* and by the horizontal cross support member 17. It is contemplated that alternative cross support members may be used to support the vertical walls 16, 18. It is also contemplated that alternative structural vertical members other than wall members that include the corrals may be substituted for the vertical wall members.

The contact support structure B pivots forward and rearward between the vertical walls 16, 18 about the contact support pivot 22. The contact support pivot 22 extends beyond the end of the first and the second side contact support members 20*a*, 20*b* and into the corresponding holes in the vertical walls 16, 18. In its rearmost position the contact support engages the upper surface of the horizontal cross support member 17. The rearward motion may be extended as shown in FIG. 3 by removing a section of the cross support member identified as the lower support slots 51*a*, 51*b*. The contact support members 20*a*, 20*b* can then extend through lower support slots 51*a*, 51*b* to increase the overall rearward motion of the contact support structure A. A control rod 28 is positioned at the center of the front roller 24. The control rod 28 may include nuts or other fastening means for securing the front roller within the slots 29*a* and 29*b*. For example, a control handle 27 is shown in FIG. 3.

The body support platform assembly C is comprised of multiple articulating panels that include a lumbar platform 44, a back platform 42 and a seat platform 46. The body support platform can optionally include a head platform 40 or a leg platform 48; or both. The angular position of the lumbar platform 44 can also be fixed to be parallel to the back platform 42 thereby creating a singular back platform. An axle 32 is allowed to rotate about the back side of the lumbar platform within connector brackets 49. Alternative means of attaching an axle 32 may also be used. The axle extends beyond each outer edge of the lumbar platform 44 into corrals 30*a*, 30*b*. The corrals are generally oval shaped openings positioned in the first and second walls 16, 18 of the base structure A. Alternatively shaped or configured corrals may also be used without departing from the inventive concept disclosed herein. Although the corrals are shown extending through the entire thickness of the vertical wall members 16, 18, it is possible to use corrals that do not extend completely through the thickness of the wall members. It is also possible to use a single corral in one of the walls of the base or attached near the center of the axle rather than using a corral in each of the walls. Yet further, it is possible to attach corrals to one or more of the substantially vertical wall members.

Because the corrals 30*a*, 30*b* are larger in diameter than the outer diameter of the axle 32, the axle 32 is free to rotate within the corral. In addition, the axle 32 is free to move in a horizontal or a vertical direction between the corral walls.

As the person sitting in the chair shifts their body weight, the body support platform assembly C moves. Because the axle 32 is attached to the body support platform assembly C and the axle 32 moves relative to the corrals 30*a*, 30*b*, the body support platform assembly C also moves relative to the corrals 30*a*, 30*b* and relative to the base structure A. Because the back platform 42 is rotatably attached to the top of the lumbar platform 44, the back platform 42 moves when the lumbar platform 44 moves. When the lumbar platform moves up or down, the back platform 42 also moves up or down. As the back platform moves up or down, it can also move across the freely rotating rear roller 26.

Similarly, because the seat platform 46 is rotatably attached to the bottom of the lumbar platform 44, the seat platform 46 moves when the lumbar platform 44 moves. When the lumbar platform 46 moves forward or backward, the seat platform 46 also moves forward or backward. As the seat platform moves forward or backward, it moves across the rotating front roller 24.

The body support platform assembly B can be moved from a generally upright position as shown in FIG. 1 to a reclined position as shown is FIG. 4. In FIG. 1 the contact support structure B is in the forward position while in FIG. 4, the contact support structure B is in the rearward position. As a result of the geometry and dynamic relationship between the contact support structure B and the body support platform assembly C, the body support platform assembly B remains stable throughout the range of forward or rearward positions of the contact support structure B. This allows a person to sit comfortably in the chair as the body support platform assembly C and the contact support structure remain in a state of equilibrium. It is also possible for a person to sit in the chair with the axle floating freely within the corrals. This surprising and unexpected advantage is caused by the effect of friction acting upon the contact support structure B, which acts as a fulcrum. If desired, the position of the contact support structure B can be fixed by securing the control handle or other retaining means on the control rod 28 (Shown in FIGS. 3, 4, 5). For example, a control handle 27 is shown in FIG. 3. The angular position of the control rod is shown as Θ in FIGS. 1 and 4.

When the contact support structure B is fixed in position relative to the support structure A, the body support platform assembly C can move about the front and rear rollers 24,26 and the lumbar platform 44 can move within the limited range provided by the corrals 30*a*,30*b*. The result is that the chair motion can be focused to stretch the back muscles while limiting the reclining motion.

Figure 5:
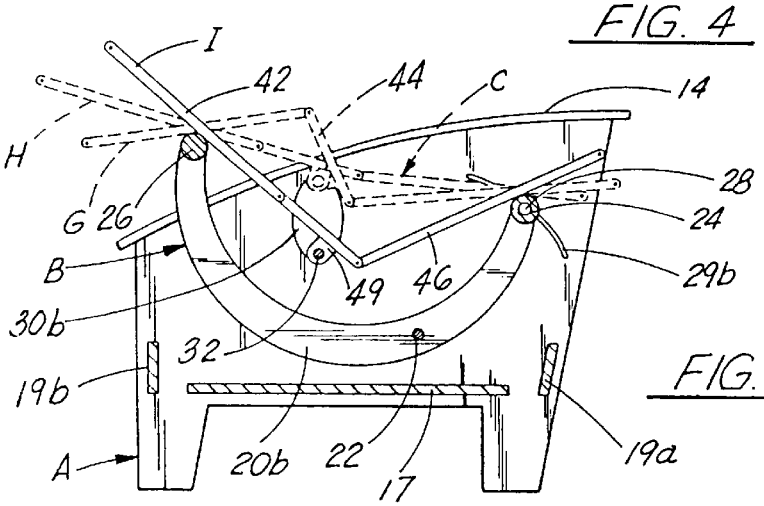
FIG. 5 is a longitudinal sectional view of the chair showing the effect of shifting body weight on the body support platform assembly and the axle member.
Figure 6:
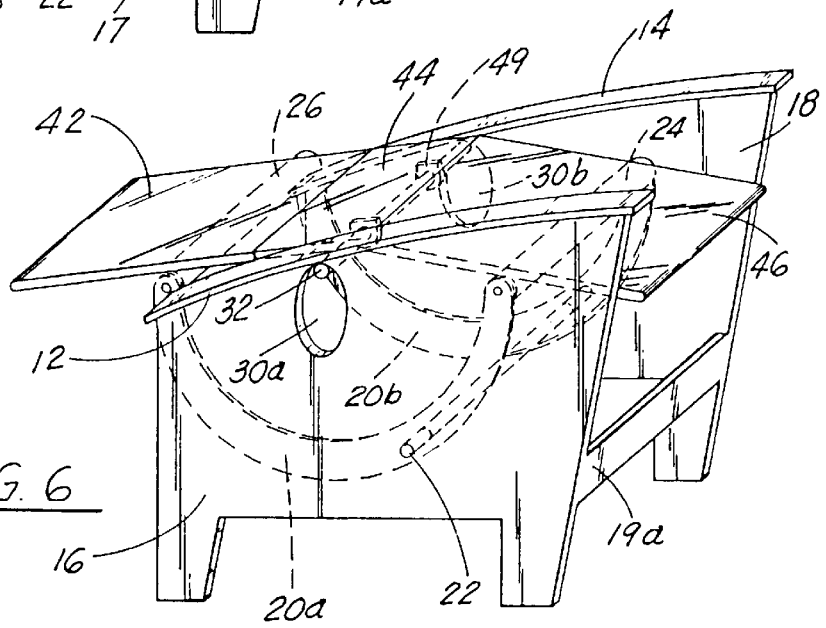
FIG. 6 is an axonometric view of the chair in a reclined and flexed position.

When the body support platform assembly C is in an inclined position as shown in FIG. 4, the body support platform assembly C can move dynamically with the corresponding motion of the contact support structure B. Regardless of whether or not the contact support structure B is secured, the body support platform assembly C can move relative to the movement of the axle 32 within the corrals 30*a*, 30*b*. In FIG. 6 the lumbar platform 44 is shown in an upward, flexed position relative to the corrals 30*a*, 30*b*. The lumbar platform 44 can be placed in the upward, flexed position by the person who is sitting in the chair by extending their back when they are inclined on the body support platform C. If the person sitting in the chair continues to arch their back, they can create an extreme reverse angle between the lumbar platform 44 and the back platform 42 as shown as back platform assembly C in position G in FIG. 5. This extreme reverse angle can be effective to isolate, sooth and relax sore, fatigued or cramped muscles in a person's back while sitting or reclining in the chair.

Figure 7:
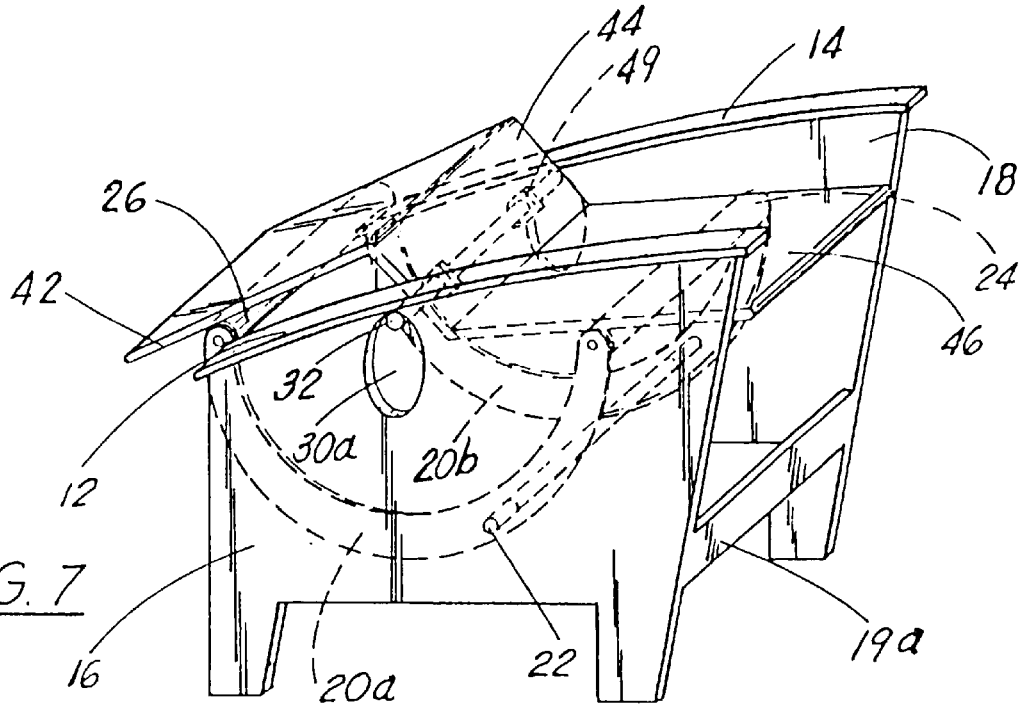
FIG. 7 is an axonometric view of the chair in a reclined, flexed and bent position showing the effect of a relatively sharp upward angle between the back section and the lumbar section.

As the lumbar platform 44 extends upward relative to the corrals 30*a*, 30*b*, a reverse angle is formed between the back platform 42 and the seat platform 46 as shown in FIG. 6. Wide ranges of angles can be formed between the interconnected back platform 42, lumbar platform 44 and seat platform 46. The variation in possible angles creates a very effective mechanism for stretching, strengthening and relieving tension in back muscles. In FIG. 5, for example the body support platform C is shown in the inclined position as I when the axle 32 and lumbar platform 44 are positioned at the bottom of the corrals 30*a*, 30*b*. As the axle 32 and lumbar platform 44 are moved upward within the corrals 30*a*, 30*b*, the body platform C forms a generally flat profile illustrated as position H. Position G shows the bent, reverse angle configuration of the body support platform assembly B when the axle 32 and lumbar platform 44 are positioned at the top of the corrals 30*a*, 30*b* and the back platform 42 is moved forward along the rear roller 26 (also refer to FIG. 7). The back platform 42 can also be moved forward and backward to increase the changing angle between the back platform 42 and the lumbar platform 44. This rocking motion and variation in angle between the back platform 42 and lumbar platform 44 creates a soothing, stretching effect on the back muscles.

The inventor also contemplates an alternative embodiment that includes a spring member that is substantially attached to the base structure. The spring member can extend between the horizontal support member and an upper position. An axle member can be attached to the spring at the upper portion of the spring member. The axle is rotatably attached to at least one section of the body support platform. The geometry and construction of the spring allows the axle to move within a predetermined area that defines a generally annular shaped corral. Because the axle is attached to a section of the body support platform assembly, the section of the body support assembly is allowed to move about the motion of the spring. The spring may be constructed of a variety of materials including but not limited to tempered steel or graphite reinforced carbon fiber or other resilient, supportive materials.

Because many varying and different embodiments may be made within the scope of the inventive concept herein taught, and because many modifications may be made in the embodiments herein detailed in accordance with the descriptive requirements of the law, it is to be understood that the details herein are to be interpreted as illustrative and not in a limiting sense. The inventor also foresees applications for the mechanism including, but not limited to: passenger seating, beds, and specialty medical equipment such as wheelchairs, examination tables and the like.

What is claimed is:

1. A multiple direction, reclining and stretching chair comprising:

a. a base structure, a body platform and a contact support structure;

b. said contact support structure having at least two contact members positioned substantially transverse to a longitudinal axis of said contact support structure;

c. said base structure including a support device for supporting said contact support structure;

d. said body platform having at least two interconnecting planar members;

e. an axle member having at least one end extending transverse to and engaged with at least one of said planar members, said axle member extending beyond at least one edge of said at least one planar member;

f. said body platform being positioned on said at least two contact members wherein said two contact members engage said at least two planar members and said contact support structure being positioned between said body platform and said base structure;

g. said base structure having at least one side member having a corral defined by an annulus therein;

h. at least one end of said axle member extends into the corral of said at least one side member of said base;

i. wherein the minimum distance measured across the annulus of said at least one corral is at least approximately one and one-half times the diameter of said axle member, whereby said axle is free to move within said corral in a vertical and a horizontal direction, resulting in relatively free motion between said body platform and said base.

2. A multiple direction, reclining and stretching chair as claimed in claim 1 wherein each end of said axle extends into each of said corrals.

3. A multiple direction, reclining and stretching chair as claimed in claim 1 wherein said corrals extend through the entire thickness of said at least two side members.

4. A multiple direction, reclining and stretching chair as claimed in claim 1 wherein said contact members are substantially cylindrically shaped rollers.

5. The multiple direction, reclining and stretching chair as claimed in claim 1 wherein said support device comprises at least one pivot member, said at least one pivot member has at least one end that extends to either side of said contact support structure and is engaged with said base structure.

6. The multiple direction, reclining and stretching chair as claimed in claim 5 wherein an adjustment mechanism is formed on a portion of said side walls of said base whereby said adjustment mechanism can selectively adjust the position of said contact support structure relative to said base structure.

7. The multiple direction, reclining and stretching chair as claimed in claim 1 wherein said support device comprises at least one arcuate member having an outer edge about the periphery of said arcuate member and wherein said outer edge contacts a substantially horizontal member extending between said at least two side members of said base whereby said contact support structure rocks relative to said base structure.

8. A rocking, reclining and stretching chair as claimed in claim 1 wherein said articulated body platform is covered with a resilient material substantially about the planar surface thereof.

9. A rocking, reclining and stretching chair comprising:

a. a base structure, a contact support structure and an articulated body support platform;

b. said contact support structure having at least two contact members for engaging said articulated body support platform;

c. said base structure including a support component for supporting said contact support structure;

d. said articulated body support platform having an axle member engaged with said articulated body support platform, said contact support structure being positioned between said articulated body platform and said base structure, wherein said articulated body support platform can move relative to said contact members;

e. said base structure having at least two vertical wall members, at least one of said wall members having a confining annulus for controlling the overall movement of said axle member, wherein said confining annulus has a minimum diameter in all directions of at least one and one-half times the diameter of said axle member;

f. said axle member having at least two ends wherein at least one of said ends extends into an opening in said at least one confining annulus, thereby allowing said axle and said body platform to move relative to the openings in said confining annulus.

10. A rocking, reclining and stretching chair as claimed in claim 9 wherein said contact members are substantially cylindrically shaped rollers.

11. A rocking, reclining and stretching chair as claimed in claim 9 wherein said support device comprises at least one pivot member for allowing said contact support structure to pivot forward and rearward relative to said base structure.

12. A rocking, reclining and stretching chair as claimed in claim 11 wherein said base includes an adjustment mechanism on at least one of said walls for selectively securing said roller support structure within said base.

13. A rocking, reclining and stretching chair as claimed in claim 9 wherein said articulated body platform is covered with a resilient material substantially about the planar surface thereof.

14. A rocking, reclining and stretching chair as claimed in claim 9 wherein said articulated body support platform includes multiple platforms, each of said multiple platforms having an adjustable tensioning means whereby the angular position between each of said multiple platforms can be selectively changed.

15. A multiple direction, reclining and stretching chair comprising:

a. a base structure, a body platform and a contact support structure;

b. said contact support structure having at least two contact members positioned substantially transverse to the longitudinal axis of said contact support structure;

c. said base structure including means for supporting said contact support structure;

d. said body platform having at least two interconnecting planar members;

e. an axle member having two ends extending transverse to and engaged with at least one of said planar members;

f. said body platform being positioned on said at least two contact members wherein said two contact members substantially engage said at least two planar members and said contact support structure being positioned between said body platform and said base structure;

g. said base structure having a confining means for limiting the motion of said axle member to an area substantially defined by the shape of an annular corral; wherein said annular corral has a minimum diameter of at least one and one-half times the diameter of said axle member.

16. A reclining or stretching chair comprising:

A base structure, a contact support structure and a body support platform wherein:

Said base structure includes at least one substantially vertical wall member having a corral opening therein;

Said contact support structure is positioned above said base structure and includes at least one pivot point positioned between said contact support structure and said at least one substantially vertical wall member;

Said body platform assembly having at least one planar member in contact with said contact support structure about at least one contact point; and An axle member carried by said body platform assembly which cooperates with said corral to guide said body platform assembly as it moves relative to said base structure.

17. The apparatus as claimed in claim 16 wherein said corral opening is substantially oblong shaped and said axle member extends into said opening.

18. The apparatus as claimed in claim 17 wherein said corral opening is at least one and one half times the diameter of said axle member in all directions.

19. The apparatus as claimed in claim 16 wherein said corral opening is in the shape of a slot.

20. The apparatus as claimed in claim 16 wherein said corral opening is in the shape of a circle.

21. The apparatus as claimed in claim 16 wherein said corral opening is amorphous in the shape and further includes semi-circular regions about the perimeter thereof.

22. The apparatus as claimed in claim 16 wherein said at least one pivot point on said contact support structure comprises a longitudinal member positioned substantially transverse to and engaged with said base structure.

23. The apparatus as claimed in claim 22 wherein said longitudinal member includes a handle for adjusting the rotational position of said contact support structure.

24. The apparatus as claimed in claim 16 wherein said contact support structure includes a control rod substantially attached thereto and spaced from said pivot point and moveably connected with said at least one wall member of said base structure.

25. The apparatus as claimed in claim 24 wherein said control rod extends through a slot positioned in said at least one wall of said base structure.

26. The apparatus as claimed in claim 25 wherein said control rod further includes a control handle positioned for securing said control rod relative to said base structure.

27. The apparatus as claimed in claim 24 wherein said control rod extends into a slot positioned on a guide structure; said guide structure being positioned in a substantially parallel relationship to said contact support structure, between said contact support structure and said at least one wall of said base structure.

28. The apparatus as claimed in claim 27 wherein said control rod further includes a control handle positioned for securing said control rod relative to said base structure.

29. A reclining or stretching chair as claimed in claim 16 wherein said at least one pivot point is positioned on a lower side of said contact support structure.

30. A reclining or stretching chair as claimed in claim 29 wherein said base structure has two spaced apart contact support pivots and said contact support structure has two notches which are received by said contact support pivots consecutively as said contact support structure pivots relative to said base structure.

31. A reclining or stretching chair as claimed in claim 29 wherein said contact support structure further includes a guide structure positioned substantially parallel to said at least one vertical wall member.

32. A reclining or stretching chair as claimed in claim 16 wherein said contact support structure includes a control member on a front and on a rear of said contact support structure and wherein each of said control members extends into a corresponding guide slot positioned on a front and a rear of a guide structure wherein said guide structure is positioned on at least one of said substantially vertical wall members.

33. A reclining or stretching chair as claimed in claim 32 wherein said corral opening is oblong shaped and is at least one and one-half times the diameter of said axle member in all directions.

34. A reclining or stretching chair as claimed in claim 32 wherein said corral opening is in the shape of a slot.

35. A reclining or stretching chair as claimed in claim 16 wherein said at least one wall member includes at least one guide opening and wherein at least one pivot point comprises at least one longitudinal pivot member; said at least one longitudinal pivot member being substantially attached to said contact support structure and cooperating with said at least one guide opening; whereby said guide opening limits the overall motion of said at least one longitudinal pivot member.

36. A reclining or stretching chair as claimed in claim 35 wherein the shape of said guide opening is selected from the group consisting of: a slot, a circle, an oblong and an oval.

37. A reclining or stretching chair as set forth in claim 16 wherein said contact support structure includes at least one pivot point intermediate of said contact support structure.

38. A reclining or stretching chair comprising:

A base structure, a contact support structure and a body support platform wherein:

Said base structure includes at least one substantially vertical wall member having a corral opening therein;

Said contact support structure includes at least one front and one rear contact support member having an upper and a lower end; wherein each of said at least one contact support members includes a contact point on the upper end and a pivot point on the lower end thereof;

Said body platform assembly includes at least one planar member that contacts each of said contact support members about said contact points; and An axle member carried by said body platform assembly which cooperates with said corral to guide said body platform assembly as it moves relative to said base structure.

39. A reclining or stretching chair as claimed in claim 38 wherein said contact points on said front and rear contact support members comprise roller members positioned substantially transverse to said body platform assembly.

40. A reclining or stretching chair as claimed in claim 38 wherein the motion of said contact members are adjusted about said pivot points with control handles that are positioned to secure said contact member relative to said base structure.

41. A reclining or stretching chair as claimed in claim 38 wherein said corral shaped opening is at least one and one-half times the diameter of said axle member in all directions.

42. A reclining or stretching chair as claimed in claim 38 wherein at least one of said contact support members includes a control member substantially attached thereto.

43. A reclining or stretching chair as claimed in claim 42 wherein said control member extends into an opening in said at least one wall of said base structure.

44. A reclining or stretching chair as claimed in claim 42 wherein said control member includes a handle for securing said contact members relative to said base structure.

* * * * *